United States Patent [19]

McKee et al.

[11] 4,054,118

[45] Oct. 18, 1977

[54] COMPOUND BOW WITH TORQUE ELIMINATORS AND TENSION CABLE DEFLECTORS

[76] Inventors: Arnold D. McKee, 130 E. Elm, Hartford, Ill. 62048; Richard C. Segelken, Rte. 1 Box 160, Caseyville, Ill. 62232

[21] Appl. No.: 652,133

[22] Filed: Jan. 26, 1976

[51] Int. Cl.[2] ..... F41B 5/00

[52] U.S. Cl. ..... 124/23 R; 124/88; 124/90

[58] Field of Search ..... 124/24 R, 23 R, 90, 124/86, 80, 88

[56] References Cited

U.S. PATENT DOCUMENTS

| | | | |
|---|---|---|---|
| 2,947,301 | 8/1960 | Haulk | 124/90 |
| 3,486,495 | 12/1969 | Allen | 124/24 R |
| 3,744,473 | 7/1973 | Nishidka | 124/24 R |
| 3,812,835 | 5/1974 | Smith | 124/24 R |
| 3,841,295 | 10/1974 | Hunter | 124/24 R |
| 3,854,467 | 12/1974 | Hofmeister | 124/24 R |
| 3,923,035 | 12/1975 | Trotter | 124/86 X |

*Primary Examiner*—Richard C. Pinkham
*Assistant Examiner*—William R. Browne

[57] ABSTRACT

A compound bow with a pair of limbs having a pair of improved eccentric pulleys rotatably affixed adjacent free ends thereof and adapted to receive a bowstring and a tension cable on center line of said bow, said compound bow optionally having roller cable adjustment deflectors for use with said improved eccentric pulleys to deflect the tension cables away from a sight window in the compound bow.

7 Claims, 15 Drawing Figures

COMPOUND BOW WITH TORQUE ELIMINATORS AND TENSION CABLE DEFLECTORS

This invention relates to a compound bow wherein torque is minimized or eliminated.

Various compound bows have been designed with cables and pulleys to effect minimal draw tension in drawn condition. The first of these bows was described in U.S. Pat. No. 3,486,495 wherein an eccentric pulley with two circular, parallel bowstring tracks and a cross-over notch is disclosed.

An object of the present invention may be noted the provision of an improved eccentric pulley which is adapted to mount the bowstring and tension cable and to simultaneously align them with the center line of said bow. In so doing, however, the tension cable is moved into the path of a released arrow. Therefore, another object of the present invention is the provision of a cable adjustment deflector to prevent contact between the tension cables and a released arrow's fletching, and to deflect the tension cables away from a sight window in a compound bow.

It is the primary object of the present invention to reduce torque in a bow provided with the improved eccentric pulleys more particularly described below. In so doing, stress and possible limb damage in the bow is eliminated to the end that the bow functions and performs with the consistency and accuracy of a conventional long bow.

It is yet another object of the invention to reduce torque and introduce a more fluid movement to the bow so that a lighter arrow can be used with a heavier poundage bow.

Still other objects and features will be in part apparent and in part pointed out hereinafter.

The invention accordingly comprises the constructions hereinafter described, the scope of the invention being indicated in the following claims.

In the accompanying drawings, in which several of various possible embodiments of the invention are illustrated, FIG. 1 is a side elevational view of a compound bow with a pair of eccentric pulleys according to the present invention adjacent opposite ends thereof and with a pair of cable adjustment deflectors therebetween;

Corresponding reference characters indicate corresponding parts throughout the several views of the drawings.

Figure 1:
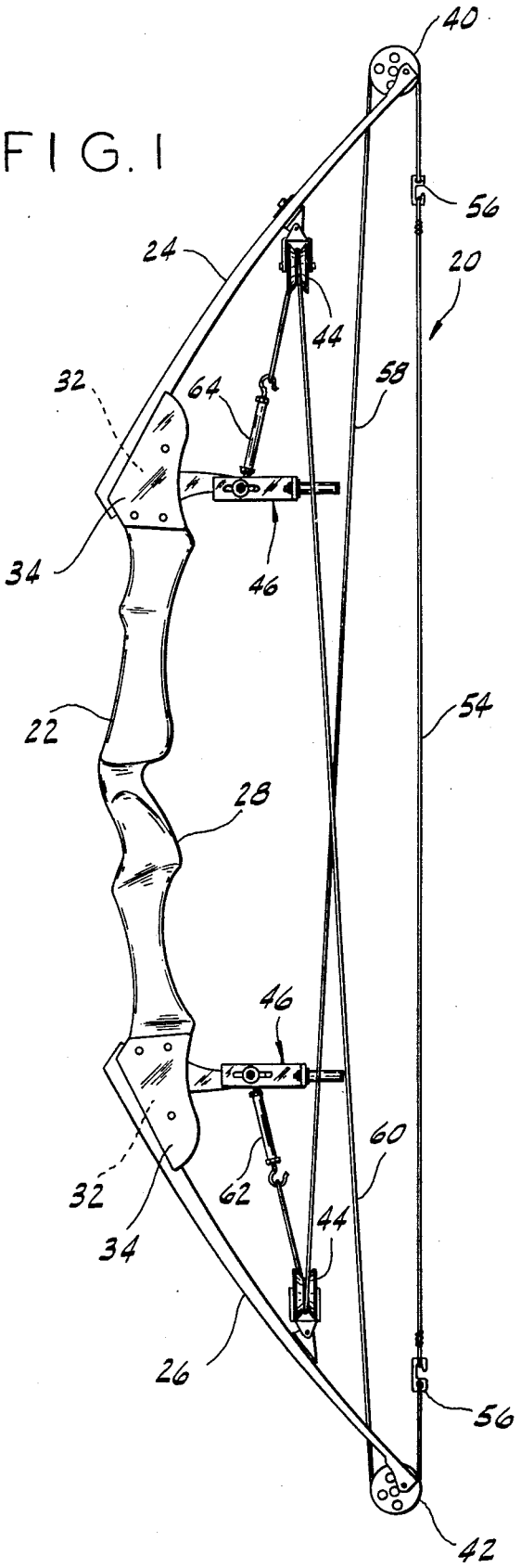

A compound bow 20 as shown in FIG. 1 has an elongated central handle or riser portion 22 and a pair of upper and lower limbs 24 and 26, respectively. The central handle 22 includes an integral grip 28 and a sight window 30. Limbs 24 and 26 are pivotably and adjustably connected at opposite ends of handle 22 by limb seats 32 which are concealed by decorative face plates 34. If it is desired to increase the draw tension of the bow, limbs 24 and 26 are pivoted in limb seats 32 so that the tips of the limbs move further apart. The opposite result is achieved by pivoting the tips closer together.

Figure 2:
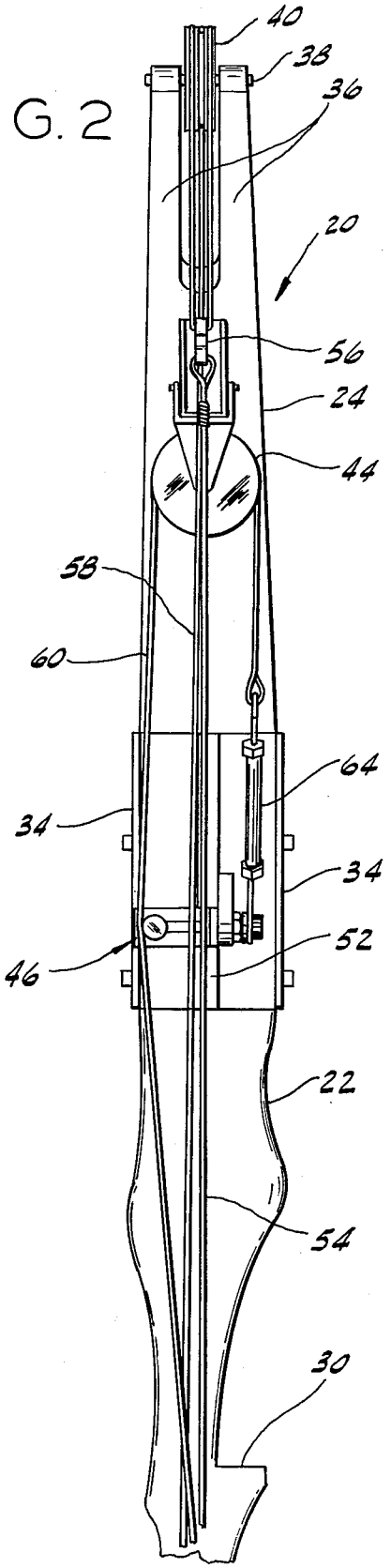
FIG. 2 is an enlarged back view of the top of the bow.
Figure 4:
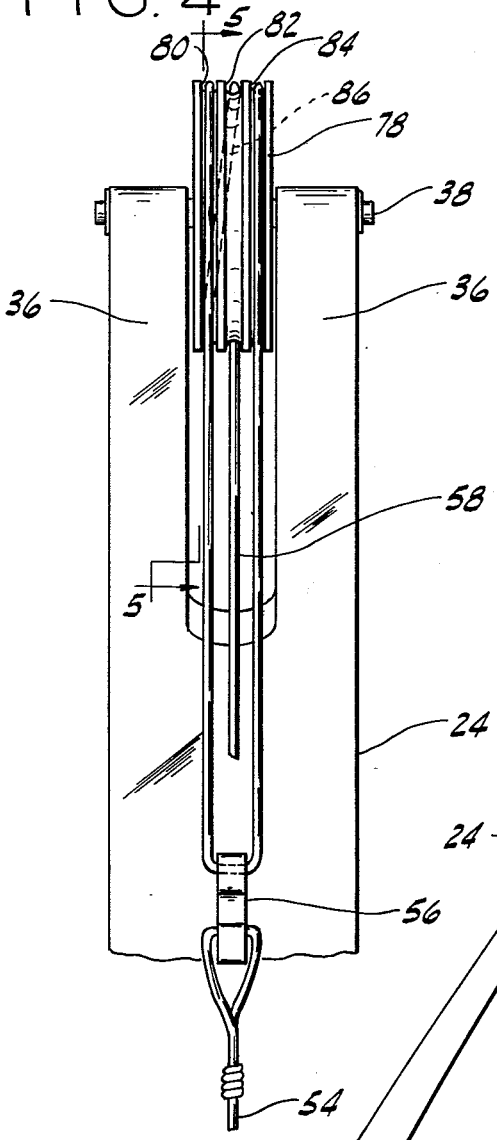
FIG. 4 is a fragmentary back view of the tip of the bow further enlarged to better show the eccentric pulley.
Figure 3:
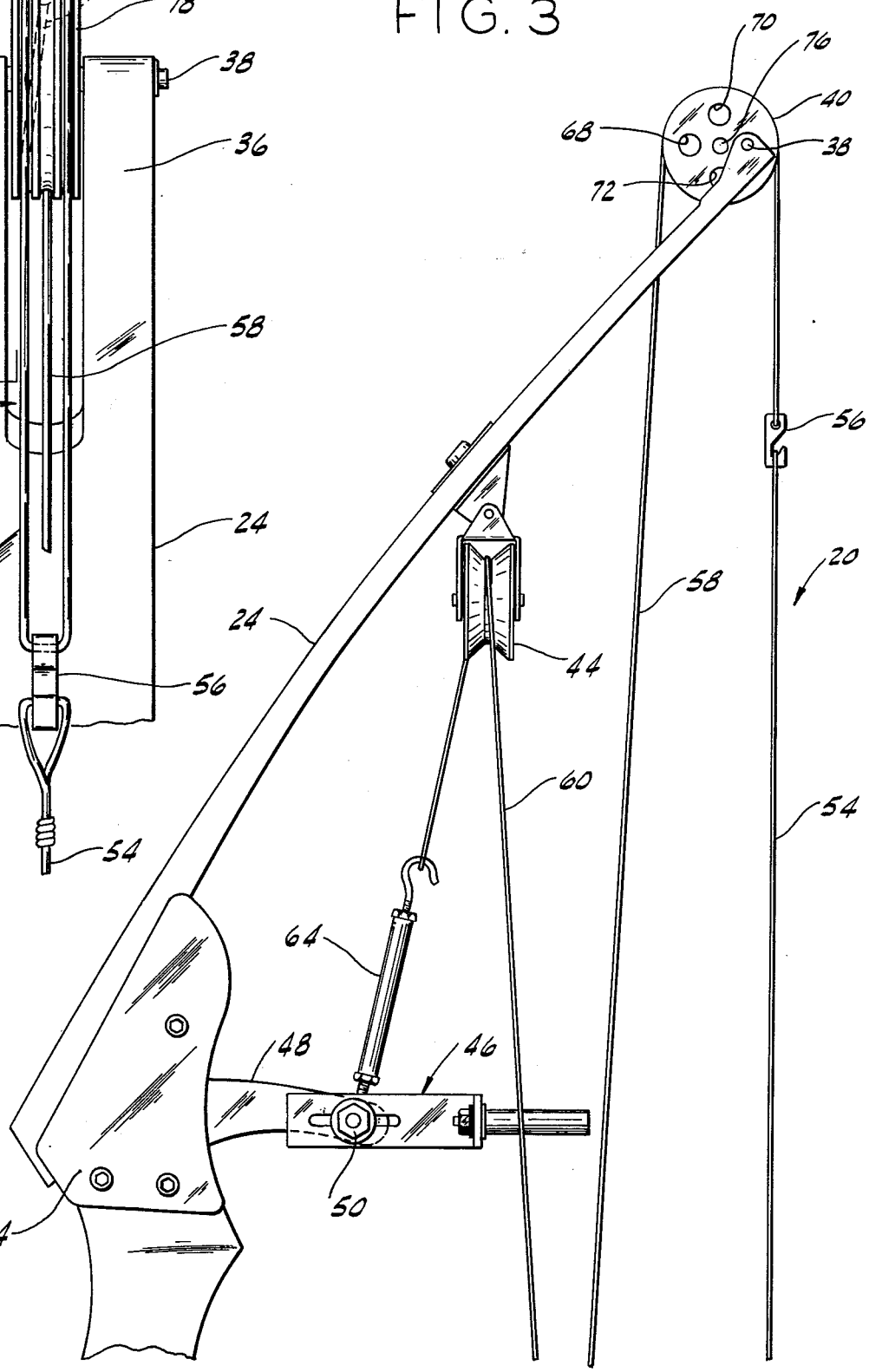
FIG. 3 is a side elevational view of the top of the bow.

Upper and lower limbs 24 and 26 are bifurcated at corresponding opposite tips 36 as best seen in FIGS. 2 and 4. Mounted between bifurcations 36 on pins 38 are upper and lower eccentric pulleys 40 and 42, respectively. Intermediate the ends of limbs 24 and 26 are pivotably mounted ordinary pulleys 44. As shown in FIGS. 1 and 3, pulleys 44 are substantially normal to eccentric pulleys 40 and 42.

Cable adjustment deflectors 46 are attached to brackets 48 by bolts 50 and are positioned between and offset from eccentric pulleys 40 and 42. As shown in FIGS. 1–3, brackets 48 are slightly curved, elongated member attached by integrally formed ribs 52 to handle 22. Ribs 52 are aligned with the center line of the handle and are located at opposite ends thereof facing the archer.

A bowstring 54 is connected at opposite ends by hooks 56 to cables 58 and 60, respectively. Cable 58 is wrapped around upper eccentric pulley 40, passed around lower ordinary pulley 44 and tied off on lower bracket 48 to turnbuckle 62. Cable 60 is correspondingly wrapped around lower eccentric pulley 42, passed around upper ordinary pulley 44 and tied off on upper bracket 48 to turnbuckle 64. Turnbuckles 62 and 64 are used to fine tune the bow so that rotation of eccentric pulleys 40 and 42 is synchronized when the bow is drawn. They also serve as adjusting means to lengthen or shorten the bow draw lenght and thereby vary the draw tension of the bow.

As shown, eccentric pulleys 40 and 42 are identical in size and shape and are designed to fit either the upper or lower limb of either a right- or left-handed bow. Moreover, they are shown as circular in configuration and $1\frac{3}{4}$ inches in diameter. Other configurations and dimensions are also contemplated. In general, the shape of the eccentric pulley will affect the force necessary to draw the bow and the diameter of the pulley will affect the draw length. The shape and size of the pulleys is therefore limited only by the performance characteristics sought.

Each of eccentric pulleys 40 and 42 includes a pivot hole 66 adjacent the periphery thereof and a diametrically opposing, counterbalancing lightening hole 68.

Additional lightening holes 70 and 72 are equally spaced 90° from holes 66 and 68. All of the holes are substantially normal to the flat sides of the pulley and are 0.435 inch from the center thereof. Their diameters, however, differ. Hole 66 is 3/16 inch in diameter while hole 68 is ¼ inch and holes 70 and 72 are ⅜ inch to receive a ball clamp to tie off the cable as hereinafter described. The diameters vary to accommodate the pivot pins of most commercially available compound bows. Depending on the diameter of pins 38, one of the holes is selected as the pivot hole while the others function as lightening holes to reduce the inertial weight of the pulley and to maintain the balance thereof.

A tapped center hole 74 having a diameter of ¼ inch is drilled through each of pulleys 40 and 42 for receipt of a set screw 76. Set screw 76 is provided to prevent cables 58 and 60 from slipping on eccentric pulleys 40 and 42, respectively, once the desired length of cable stretch between hooks 56 and pulleys 40 and 42 has been selected as described more particularly below.

As shown, the peripheral edge 78 of each eccentric pulley is 0.500 inch wide. Three circular, symmetrically spaced grooves 80, 82 and 84 serve as cable tracks. As shown, grooves 80, 82 and 84 have substantially uniform diameters of 1.550 inches and are substantially 0.100 inch wide to accommodate most ordinary cable sizes. While it is not essential that the diameters of grooves 80, 82 and 84 be uniform, it is preferred that the diameter of grooves 80 and 84 be the same. Center groove 82 is preferably beveled to reduce cable drag.

Figure 5:
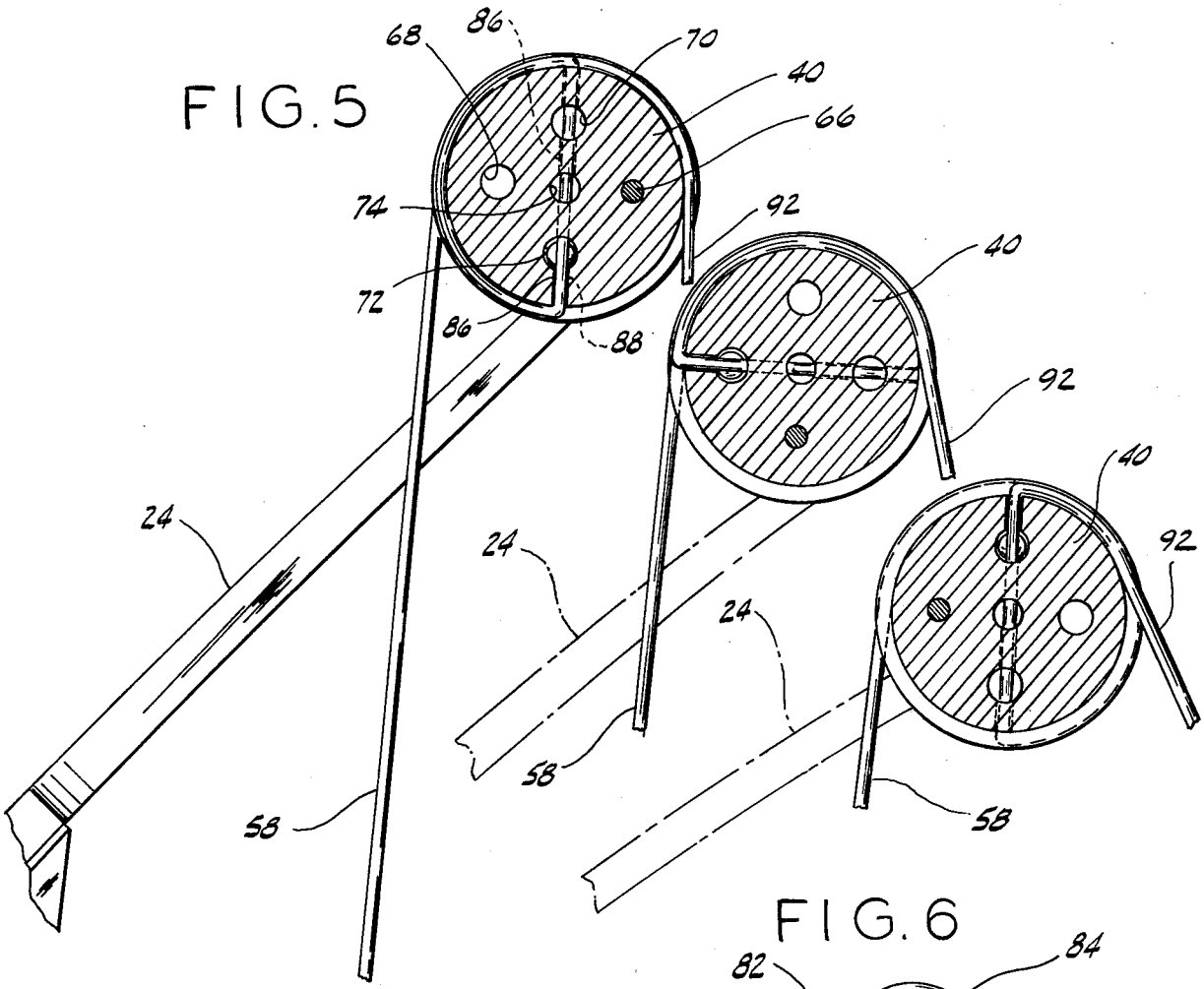
FIG. 5 is a side elevational view in longitudinal cross-section of the tip of the bow taken along line 5—5 in FIG. 4; shown in broken lines is the bow in intermediate and drawn positions.
Figure 6:
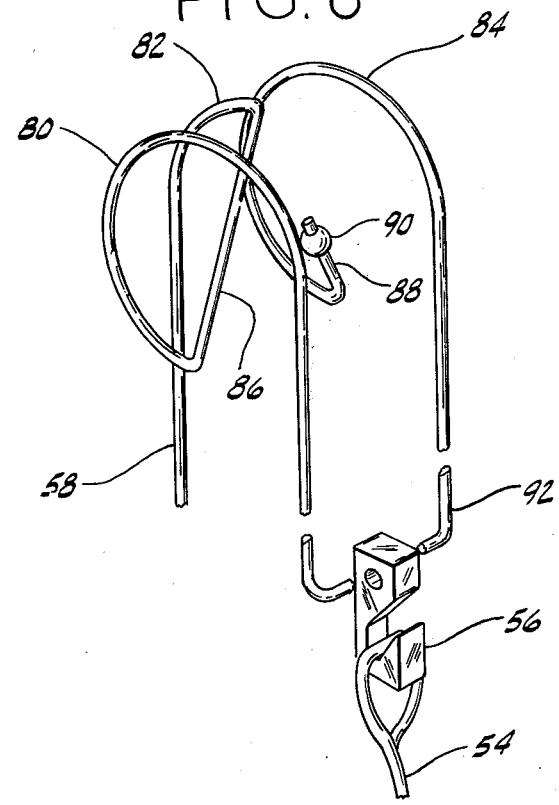
FIG. 6 is a schematic representation of the threading of the eccentric pulley shown in FIG. 1.

As best seen schematically in FIG. 6 and understood in combination with FIG. 5, a first passageway 86 in radial alignment with hole 70 slantingly connects center groove 82 with outside groove 80 substantially 180° apart. A second passageway 88 in radial alignment with hole 72 slantingly connects outside groove 84 and hole 72. Both passageways have a diameter of 7/64 inch to freely receive most ordinary sized cables. Passageway 88 is slanted to accommodate ball clamp 90, one of which ties off each of cables 58 and 60 to pulleys 40 and 42, respectively.

For purposes of clarity, corresponding segments of cable 58 have been numbered with passageway and groove reference numerals in FIG. 6. Referring to FIG. 6 which shows the threading of eccentric pulley 40 as viewed when the bow is in undrawn condition, cable 58 makes approximately a one-quarter clockwise wrap in center groove 82 before it passes through first passageway 86 to outer groove 80. It then makes approximately a three-quarters clockwise wrap in outer groove 80 before it passes in a loose loop 92 to outer groove 84. In outer groove 84, it makes approximately a three-quarters counterclockwise wrap before it passes through second passageway 88 where it is tied off in hole 72 with ball clamp 90. Except for the direction of wrap, pulley 42 is threaded with cable 60 in the same manner that pulley 40 is threaded with cable 58.

Loop 92 is of sufficient length that eccentric pulley 40 is pivotable as described below through half a turn to the last position shown in FIG. 5 and back to the first position without contacting hook 56 which serves as the mount for bowstring 54. With reference to the drawings, it is seen that cable 58 rolls on eccentric pulley 40 without tangling.

Since loops 92 are centered with respect to eccentric pulleys 40 and 42, bowstring 54 is also centered as are cables 58 and 60 in center grooves 82. Hence it is seen that eccentric pulleys 40 and 42 are adapted to mount the bowstring and tension cables and simultaneously align them with the center line of said bow.

Although particular dimensions have been set forth above for pulleys 40 and 42, it will be understood that other pulley sizes, hole diameters and placements, groove widths and depths or the like are also contemplated and are a matter of design choice.

Figure 9:
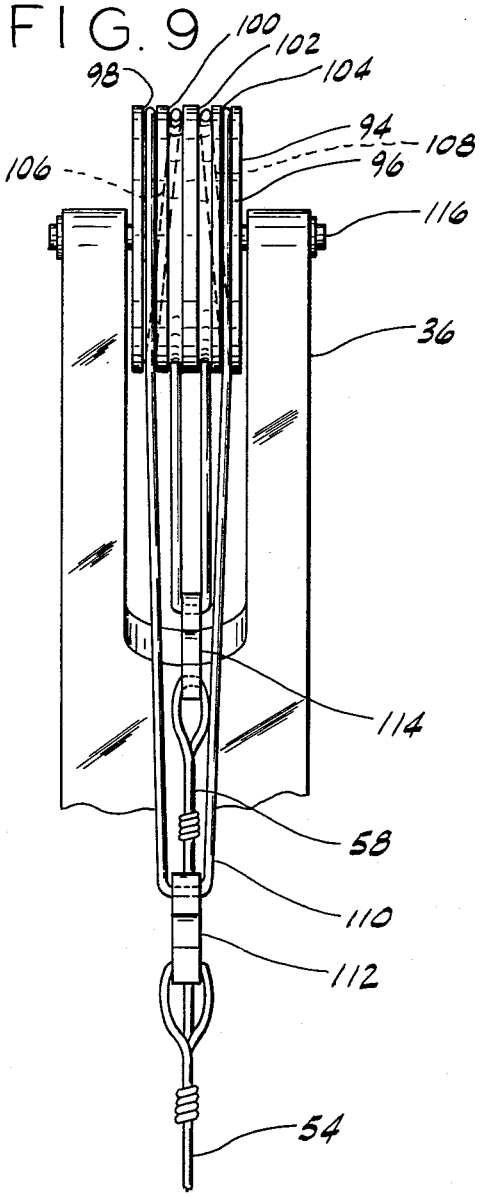
FIG. 9 is a view like FIG. 4 but shows an alternate eccentric pulley.
Figure 10:
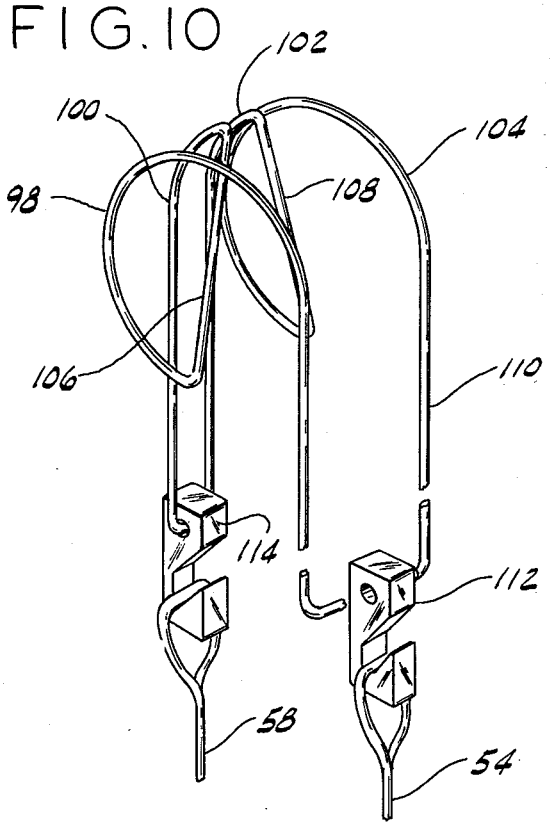
FIG. 10 is like FIG. 6 but shows the threading of the alternate eccentric pulley.

Another eccentric pulley 94 according to the present invention is shown in FIGS. 9 and 10. In this embodiment, peripheral edge 96 has four circular, symmetrically spaced grooves 98, 100, 102 and 104 which serve as cable tracks like grooves 80, 82 and 84. Like grooves 80, 82 and 84, grooves 98, 100, 102 and 104 are shown as substantially uniform in diameter and width. It is not essential, however, that the diameters of grooves 98, 100, 102 and 104 be uniform but it is preferred that the diameters of grooves 98 and 104 and of grooves 100 and 102 be the same.

As best seen schematically in FIG. 10, a first passageway 106 is provided in radial alignment with the lightening hole opposite the pivot hole and connects left center groove 100 with outer groove 98. A second corresponding passageway 108 connects right center groove 102 with outer groove 104.

A length of cable forming a continuous loop 110 is wrapped around pulley 94 and held in place by set screws (not shown). One end of loop 110 connects bowstring 54 by hooks 112 and the other connects cables 58 and 60 by hooks 114. Loop 110 like loop 92 is of sufficient length that eccentric pulley 94 is pivotable similarly to eccentric pulleys 40 and 42 without contacting hooks 112 and 114. By wrapping loop 110 as shown in FIG. 10, bowstring 54 is centered with respect to pulleys 94 as are cables 58 and 60.

In use when bowstring 54 is drawn as shown in FIG. 5, eccentric pulleys 40 and 42 pivot on pins 38. Continued drawing of bowstring 54 effects continued rotation of eccentric pulleys 40 and 42 and unwinding of cable 58 from outer grooves 80 and 84 lengthening loop 92, with a corresponding winding of cable 58 into center groove 82. Since eccentric pulleys 40 and 42 are synchronized by appropriate adjustments of turnbuckles 62 and 64, they rotate at the same rate so that when the bow is in the last position shown in FIG. 5, the tension required to hold the bow in drawn condition is minimized.

Similarly alternate pulley 94 pivotes on pin 116 while loop 110 unwinds from grooves 98 and 104 and winds into grooves 100 and 102. Like pulleys 40 and 42, eccentric pulleys 94 maintain bowstring 54 and cables 58 and 60 on center line with respect to said pulleys.

In centering cables 58 and 60 with respect to eccentric pulleys 40 and 42 or alternate eccentric pulleys 94, they are moved into alignment with bowstring 54 and tend to interfere with the flight of a released arrow. This is troublesome, since contact with the cables perturbs the flight of the arrow and can damage the arrow fletching. Hence, it is preferred that cable adjustment deflectors such as adjustment deflectors 46 be provided to prevent such contact.

Figure 7:
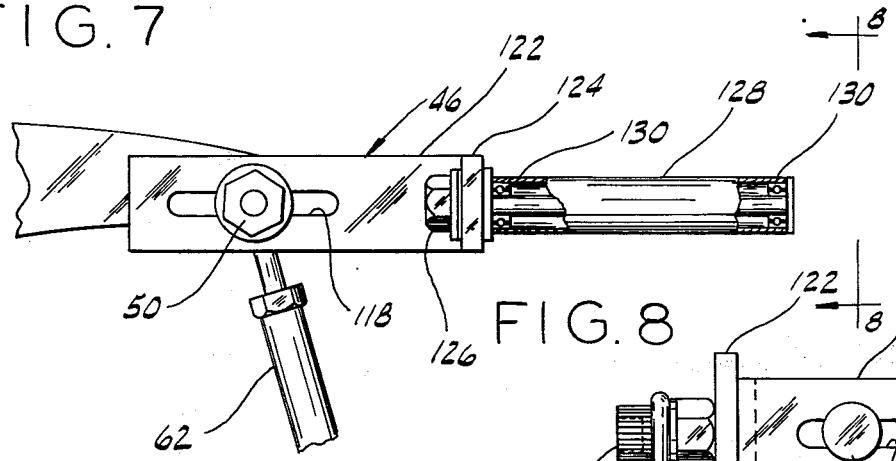
FIG. 7 is an enlarged fragmentary side elevational view of the cable adjustment deflector; shown partially broken away to show structural details.
Figure 8:
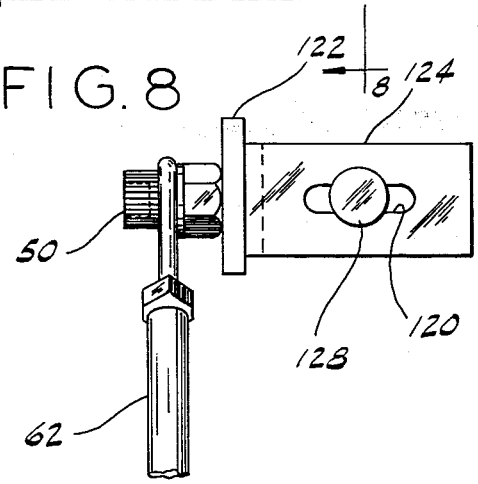
FIG. 8 is a view of the cable adjustment deflector taken along line 8—8 in FIG. 7.

As best seen in FIGS. 7 and 8 wherein lower cable adjustment deflector 46 is shown, adjustment deflectors 46 include an elongated, generally L-shaped member having slots 118 and 120 in longer and shorter legs 122 and 124, respectively. As mentioned above, adjustment deflectors 46 are mounted on brackets 48 by means of bolts 50 which pass through slots 118. Loosening bolts 50 permits movement of adjustment deflectors 46 along slots 118 to the selected position.

Mounted on shorter legs 124 in slots 120 by bolts 126 are nylon covered rollers 128 which are carried at their opposite ends by bearing races 130. Slots 120 provide for lateral movement of rollers 128 with respect to the center line of the bow.

By appropriately positioning cable adjustment deflectors by means of slots 118 and 120, rollers 128 are caused to deflect cables 58 and 60 as best seen in FIG. 2 away from the flight path of a released arrow and out of alignment with bowstring 54 adjacent sight window 30.

Figure 13:
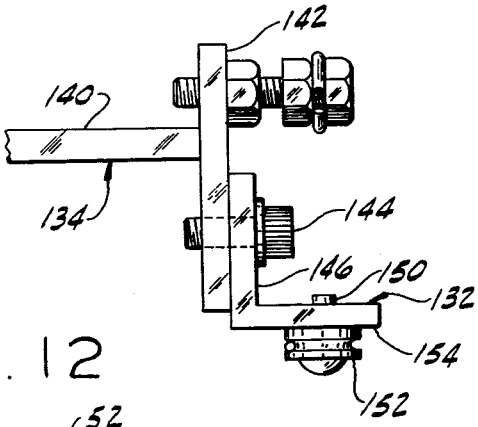
FIG. 13 is a top view of the alternate cable adjustment deflector taken along line 13—13 in FIG. 11.
Figure 12:
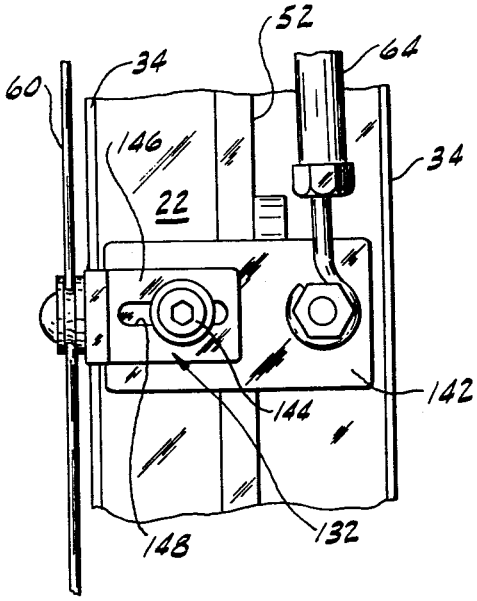
FIG. 12 is an enlarged back view of the alternate cable adjustment deflector taken along line 12—12 in FIG. 11.
Figure 11:
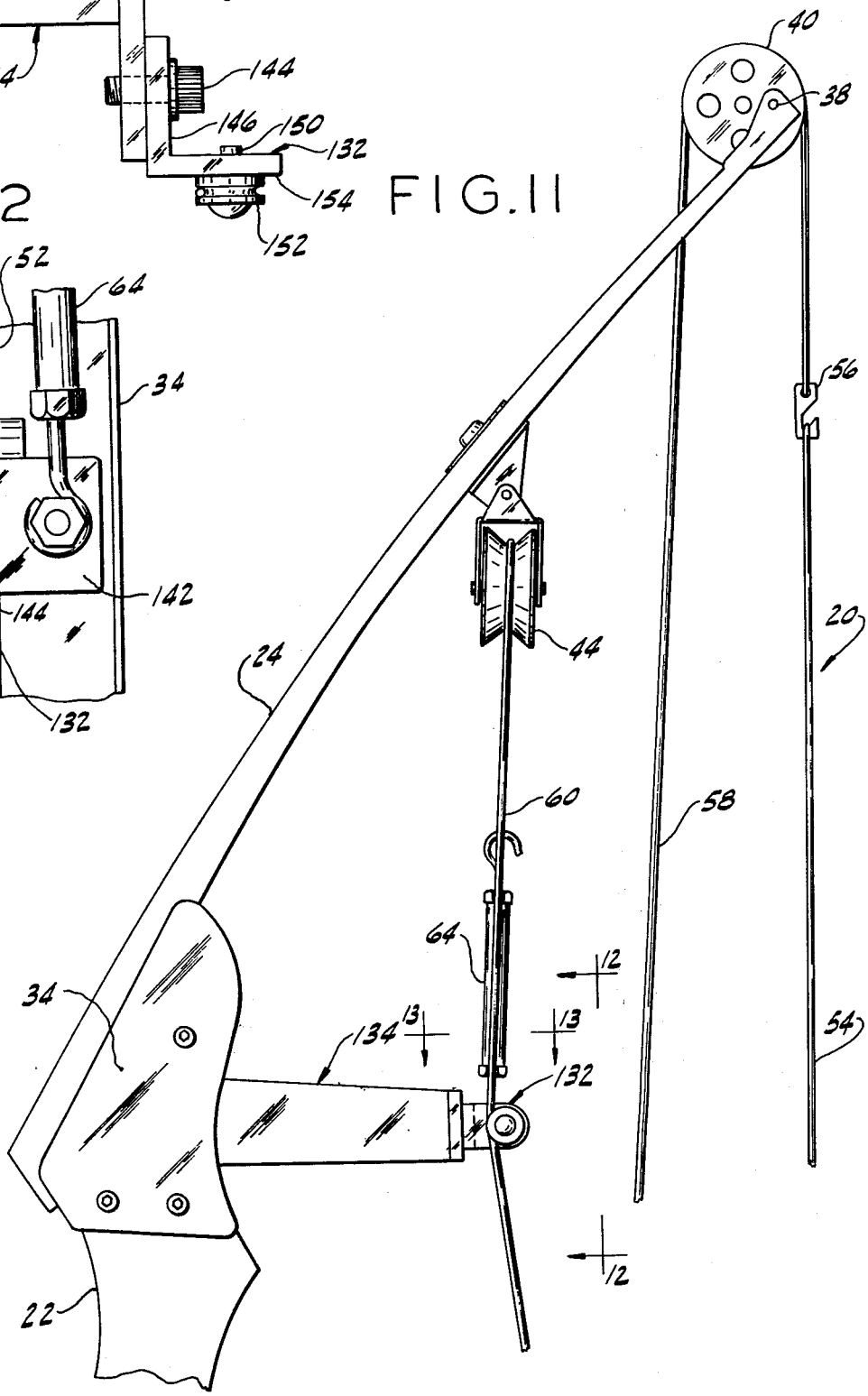
FIG. 11 is like FIG. 3 but shows an alternate cable adjustment deflector.
Figure 15:
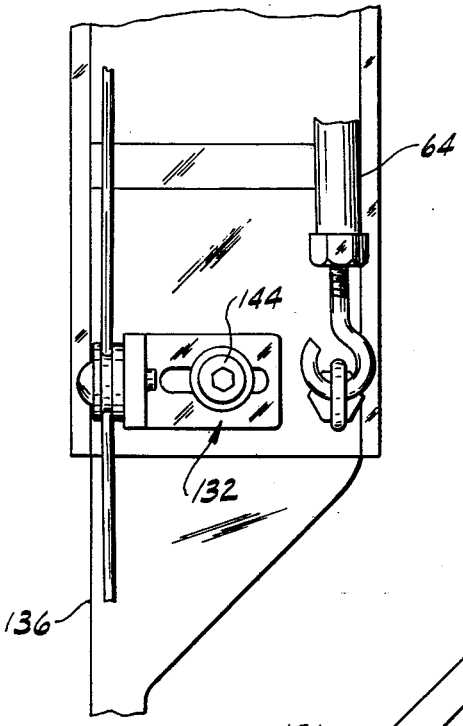
FIG. 15 is like FIG. 12 but is taken along line 15—15 in FIG. 14.
Figure 14:
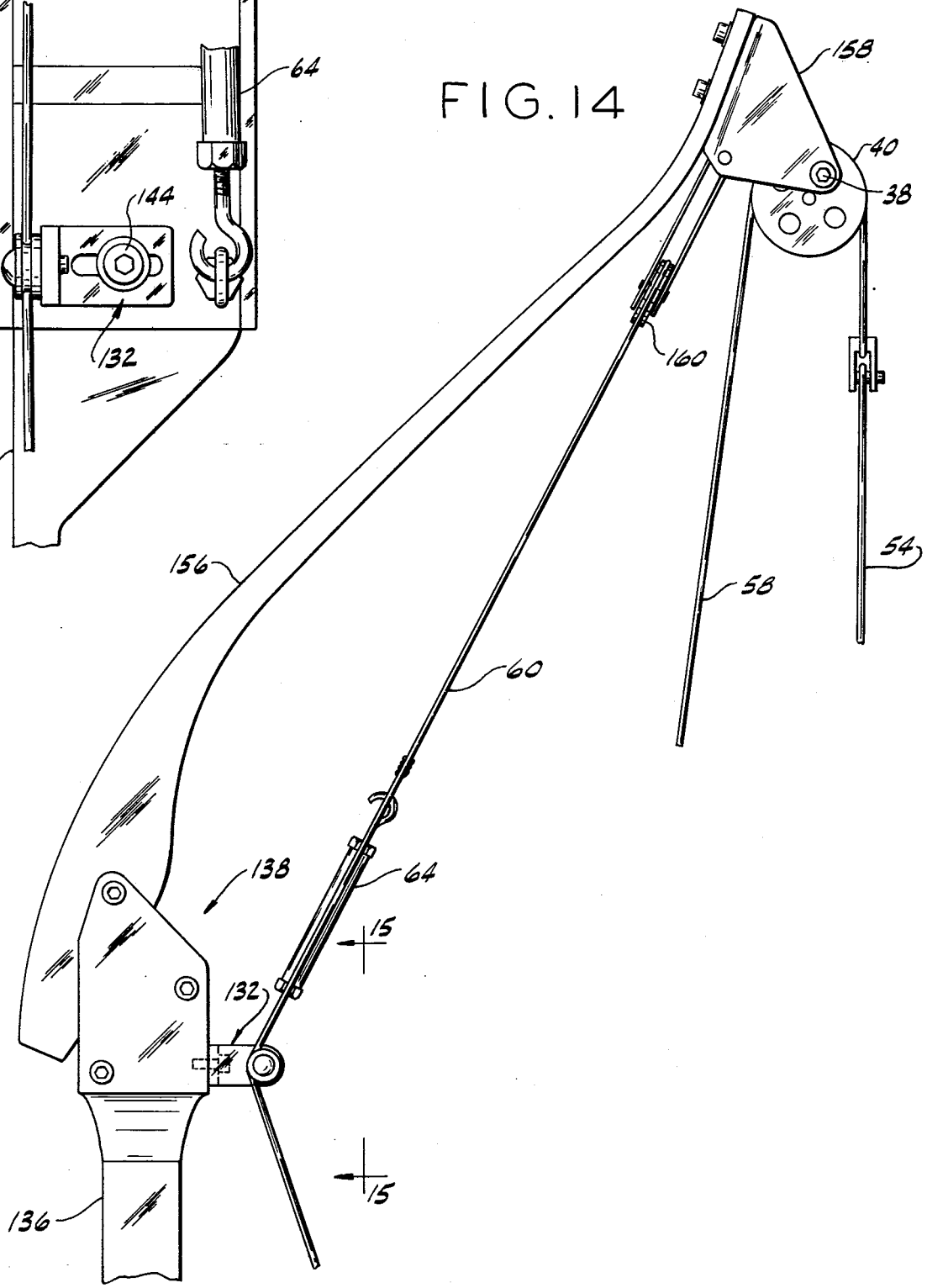
FIG. 14 is like FIGS. 3 and 11 but shows an alternate bow with the cable adjustment deflector shown in FIG. 11 affixed to the handle riser.

In FIGS. 11–15, another cable adjustment deflector 132 according to the present invention is illustrated. Cable adjustment deflectors 132, like adjustment deflectors 46, are mounted on handle 22. As shown in FIGS. 11–13, adjustment deflectors 132 are mounted on brackets 134 which are bolted to ribs 52. In FIGS. 14 and 15, on the other hand, adjustment deflectors 132 are mounted directly on handle 136 of an alternate bow 138. The particular method of attachment used for the adjustment deflectors is selected according to the design of the bow and to user preference.

Referring more particularly to FIGS. 11–13, bracket 134 is shown as generally T-shaped in cross-section with a leg 140 and a crossarm 142. Leg 140 is bolted to rib 52 and cable adjustment deflector 132 is fastened by a bolt 144 to crossarm 142.

Cable adjustment deflector 132 is L-shaped in cross-section. One leg 146 has a slot 148 and is adjustably mounted on crossarm 142 by said bolt 144. Another bolt 150 mounts pulley 152 to another leg 154. Optionally, leg 154 includes a slot (not shown) whereby the selective placement of pulley 152 in a vertical plane may be effected.

As shown in FIG. 11, cable 60 is passed under pulley 152. Cable adjustment deflector 132 is positioned on crossarm 142 so that cable 60 is displaced from sight window 30 and out of alignment with bowstring 54. Turnbuckle 64 is preferably mounted on crossarm 142, opposite cable adjustment deflector 132 in such a way that the stretch of cable connected to turnbuckle 64 and passing around pulley 44 is in the same plane as the stretch coming from pulley 44 and passing under pulley 152. This arrangement is preferred to minimize the torque around pulley 44 or bracket 134.

In FIGS. 14 and 15, cable adjustment deflector 132 is directly mounted on handle 136 by bolts 144. Adjustment deflectors 132 and eccentric wheels 40 and 42 function similarly on this bow as on bow 20. Bow limbs 156 are not bifurcated like limbs 24 and 26 but are provided with a bracket 158 which mounts eccentric wheels 40 and 42 on pins 38 as well as mounts pulley 160 which is pivotably connected thereto.

As in FIGS. 11–13, it is preferred that cable adjustment deflector 132 be positioned on handle 136 so that the cable stretch connected to turnbuckle 64 and passing around pulley 160 is in the same plane as the stretch coming from pulley 160 and passing under pulley 152.

From the foregoing, it is seen that the several objects of the invention are achieved and other advantageous results attained. It is seen that the torque normally introduced by eccentric pulleys is eliminated, thus providing a compound bow which enables a user to achieve extremely accurate and consistent performance during use. It is also clear that eccentric pulleys 40 and 42 can be sold as a kit alone or in combination with cable adjustment deflectors 46 or 132 and brackets 48 or 134 to improve existing compound bows. They can also, of course, be installed as original equipment on new bows.

As various changes could be made in the above constructions without departing from the scope of the invention, it is intended that all matter contained in the above description or shown in the accompanying drawings shall be interpreted as illustrative and not in a limiting sense.

What is claimed is:

1. In a compound bow including a frame, a pair of limbs carried by said frame, a pair of eccentric pulleys carried by said limbs and positioned adjacent the free ends thereof, a first tension cable mounted to a first one of said eccentric pulleys, a second tension cable mounted to a second one of said eccentric pulleys, and a bowstring mounted at opposite ends thereof to said eccentric pulleys, the improvement wherein said eccentric pulleys mount the bowstring and the first and second tension cables, wherein said eccentric pulleys are substantially circular in cross-section and have circumferentially disposed substantially circular symmetrically spaced grooves for receipt of mounting means whereby said bowstring and said tension cables are mounted thereto, each of said pulleys having three grooves which are substantially uniform in diameter and having four holes substantially symmetrically spaced about the margin thereof, one of which serves as a pivot to said limbs, and wherein a first passageway interconnects a first outer one of said grooves to an inner one of said grooves and wherein a second passageway interconnects a second one of said grooves to one of said holes, said passageways converging by passing substantially along the diameter of said eccentric pulleys whereby torque in said improved compound bow is reduced.

2. The compound bow according to claim 1 wherein said mounting means comprise a portion of said tension cables wrapped about said eccentric pulleys and terminating with a hook on which said bowstring is received.

3. The compound bow according to claim 2 wherein said mounting means comprise a loop of tension cable wrapped about said eccentric pulleys and terminating at an end in a hook on which said bowstring is received.

4. In a compound bow including a frame, a pair of limbs carried by said frame, a pair of eccentric pulleys carried by said limbs and positioned adjacent the free ends thereof, a first tension cable mounted to a first one of said eccentric pulleys, a second tension cable mounted to a second one of said eccentric pulleys, and a bowstring mounted at opposite ends thereof to said eccentric pulleys, the improvement wherein a pair of removable cable adjustment deflectors are carried by said frame and wherein said cable adjustment deflectors are rollers located between and offset from said eccentric pulleys and positioned to deflect said tension cables away from a sight window in said frame.

5. The compound bow according to claim 4 wherein said rollers are mounted to brackets carried by said frame.

6. The compound bow according to claim 5 which further includes a pair of pulleys carried by the limbs and spaced intermediate the free ends thereof.

7. The compound bow according to claim 6 wherein the first tension cable mounted to the first eccentric pulley carried by the first limb is wrapped around the second pulley carried by the second limb and mounted to the second bracket adjacent thereto and wherein the second tension cable mounted to the second eccentric pulley carried by the second limb is wrapped around the first pulley carried by the first limb and mounted to the first bracket adjacent thereto, that portion of the first and second tension cables adjacent said brackets lying substantially in a plane.

* * * * *